United States Patent [19]

Mustoe et al.

[11] Patent Number: 4,982,410

[45] Date of Patent: Jan. 1, 1991

[54] PLASMA ARC FURNACE WITH VARIABLE PATH TRANSFERRED ARC

[76] Inventors: Trevor N. Mustoe, A4 Dakota Apts., 2001 Coleman Rd., Anniston, Ala. 36201; Jeanie B. Gardner, 318 W. 5th St., Oxford, Ala. 36203; Alan J. Hamilton, 200 Starla Dr., Anniston, Ala. 36201

[21] Appl. No.: 340,536

[22] Filed: Apr. 19, 1989

[51] Int. Cl.[5] ..... H05H 1/00

[52] U.S. Cl. ..... 373/22

[58] Field of Search ..... 373/21-24

[56] References Cited

U.S. PATENT DOCUMENTS

| | | | |
|---|---|---|---|
| 3,429,564 | 2/1969 | Snow | 373/21 |
| 3,725,559 | 4/1973 | Nautny et al. . | |
| 3,894,573 | 7/1975 | Paton et al. . | |
| 3,932,171 | 1/1976 | Tylko . | |
| 3,936,586 | 2/1976 | Tylko . | |
| 4,154,972 | 5/1979 | Tylko . | |
| 4,217,479 | 8/1980 | Borer et al. . | |
| 4,263,468 | 4/1981 | Primke et al. . | |
| 4,394,242 | 7/1983 | Clark . | |
| 4,493,088 | 1/1985 | Lugscheider et al. . | |
| 4,651,326 | 3/1987 | Hubweber | 373/22 |
| 4,685,963 | 8/1987 | Saville . | |

*Primary Examiner*—Roy N. Envall, Jr.

*Attorney, Agent, or Firm*—Kenyon & Kenyon

[57] ABSTRACT

A plasma electric arc furnace having a plasma torch that creates a flame which impinges upon a surface of a bath of material to be heated. The impingement creates physical agitation and convection currents around the locus of impingement. Mixing currents are created on opposite sides of a motion path of the locus when this locus is moved. A motion device coupled to the plasma torch moves the torch so that the locus follows a motion path wherein portions of the mixing currents at least partially overlap one another thereby providing greater agitation of the bath and increased efficiency of agglomeration of metallic particles suspended in the bath.

4 Claims, 3 Drawing Sheets

PLASMA ARC FURNACE WITH VARIABLE PATH TRANSFERRED ARC

FIELD OF THE INVENTION

The present invention relates to a plasma electric arc furnace used for pyrometallurgical smelting processes, and more particularly, to plasma electric arc furnaces using an electrode which is movable relative to the surface of the molten bath in the furnace.

BACKGROUND OF THE INVENTION

Pyrometallurgical smelting processes involve production of metallic particles from their precursors such as oxides, sulfides or the like by reaction at high temperature with gaseous or solid reductants and separation of the resulting molten metallic and non-metallic phases. If the concentration of the metallic particles in the molten bath is low, additional metallic particles may be added to the bath or additional metal may be melted in the hearth of the furnace in order to enhance the separation and collection efficiency for the metallic particles. It is not necessary that the additional metal is the same as the metal to be recovered; the principal requirement is that the metals form a molten alloy at bath temperature. A proposed mechanism for enhancing collection involves increasing the probability of contact between particles causing agglomeration of metallic particles in the molten bath so that larger particles form. The larger particles settle out of the slag phase more quickly and form, or collect in, a molten metal phase layer. The probability of contact and agglomeration efficiency for metal particles can be enhanced by increasing the turbulence and velocity of circulatory currents in the molten bath of metallic and non-metallic phases. However, if the turbulence is too great and the circulation currents too vigorous, the agglomerated metal particles may become entrained in the slag phase preventing efficient separation. The metallic layer may be separated from the slag layer by methods well known to those skilled in the art, such as settling and tapping the metallic layer from the furnace.

These processes can be carried out in plasma electric arc furnaces for separation of finely divided particles of precious metals or precursors thereof, from mineral concentrates, non-metallic substrates or supports used for precious metal catalysts. Usually the concentration of precious metals in the feedstock to the furnace is relatively low, such as less than 1% or even less than 0.1%. It is well known to use non-precious metals such as iron, copper, nickel, lead, as collector metals to enhance the collection efficiency of the finely divided precious metals. The plasma electric arc furnace is especially suited for separation of metals with high melting points such as platinum group metals and ferro-alloys from feedstocks having high melting points because of the high heating intensity of the plasma arc flame. An example of a plasma electric arc furnace with a transferred arc flame that can be used in pyrometallurgical processes, is described in U.S. Pat. No. 4,685,963 to Saville.

A goal sought by inventors of plasma arc furnaces was to expand the volume of the high temperature arc so that the efficiency of heat transfer to solid, liquid or gaseous phase feedstocks could be increased. This was achieved in part by Tylko with a transferred plasma as described in British Patent Specification 1,390,351. Tylko moved the tip of the plasma torch in a circular path by precessing the torch through a spherical bearing located at the vertical axis of the furnace. The plasma flame formed a conical volume of high temperature ionized plasmic gas through which solid feedstock particles travelled and carried out reactions and melting resulting in production of metallic and slag layers in the bath at the base of the furnace.

Hubweber in U.S. Pat. No. 4,651,326, recognized that the high heating intensity of the plasma arc flame could cause local overheating and vaporization of the molten bath in a furnace at the impingement zone of the flame, and taught a mechanism for moving the tip of the torch universally to prevent this occurring.

Saville in U.S. Pat. No. 4,685,963 teaches that the locus of the tip of a plasma torch can be adjusted to describe a circle and produce a superheated puddle in the molten bath wherein vigorous thermal currents and physical agitation of the bath by impingement of the plasma gas can increase the agglomeration of metal particles suspended in the slag and the efficiency of recovery of the particles into the metal layer.

While adequate results for separation of metallic particles using prior art plasma arc furnaces have been achieved, further improvements in the efficiency of recovery of metallic particles remains a desired goal.

SUMMARY OF THE INVENTION

The present invention improves the efficiency of the pyrometallurgical process and the recovery of metallic particles by providing a plasma electric arc furnace for heating a bath contained in furnace walls which form a reaction chamber. A plasma torch is inserted through the roof of the furnace, which creates a flame that impinges upon a surface of the bath such that physical agitation currents are created in the bath on opposite sides of a locus of impingement of the flame. There are also thermal agitation currents on each side of the locus resulting from large temperature differentials within the bath. The physical and thermal agitation currents together make up mixing currents. A motion device moves the plasma torch such that the locus of impingement follows a motion path where subsequently created portions of the mixing currents only partially overlap existing portions of the mixing currents. Such a motion path is other than the circular paths of the prior art, and can be for example, a spiral path. By using such a spiral path, there is an expansion of the volume of the superheated bath due to interaction of subsequently created mixing currents of superheated slag. This results in an increased agglomeration effect leading to a significantly improved efficiency for the process. For example, for a pyrometallurgical process of recovery of platinum and palladium particles from catalyst substrate material in a plasma arc furnace, using a spiral path produced by mechanically continuously altering the angle of inclination from the vertical axis of the plasma torch without altering the rotation speed of the plasma torch, a reduction of platinum losses to slag of approximately 29% was achieved, as compared to a simple circular path.

The present invention is related to a plasma electric arc furnace for heating a bath, comprising: furnace walls forming a reaction chamber; a plasma torch which creates a flame that impinges upon a surface of said bath such that mixing currents are created on opposite sides of a locus of impingement, and said mixing current moves along a motion path of said locus when said locus is moved; a motion device coupled to said plasma torch, which moves the plasma torch such that said locus follows a motion path wherein subsequently created portions of said mixing current only partially overlap prior created portions of said mixing currents.

The present invention is also related to a method of recovering metallic particles from non-metallic material in a plasma electric arc furnace, comprising the steps of: creating a superheated puddle in a bath of said metallic particles and said non-metallic material by impingement of a moving plasma arc flame on said bath, with mixing currents being created on either side of the locus of the impingement of the flame; moving said locus in a motion path to thereby move said superheated puddle and create said mixing currents on either side of the motion path of said locus; and controlling the motion path of said locus such that said mixing currents at least partially overlap one another.

DETAILED DESCRIPTION

Figure 1:
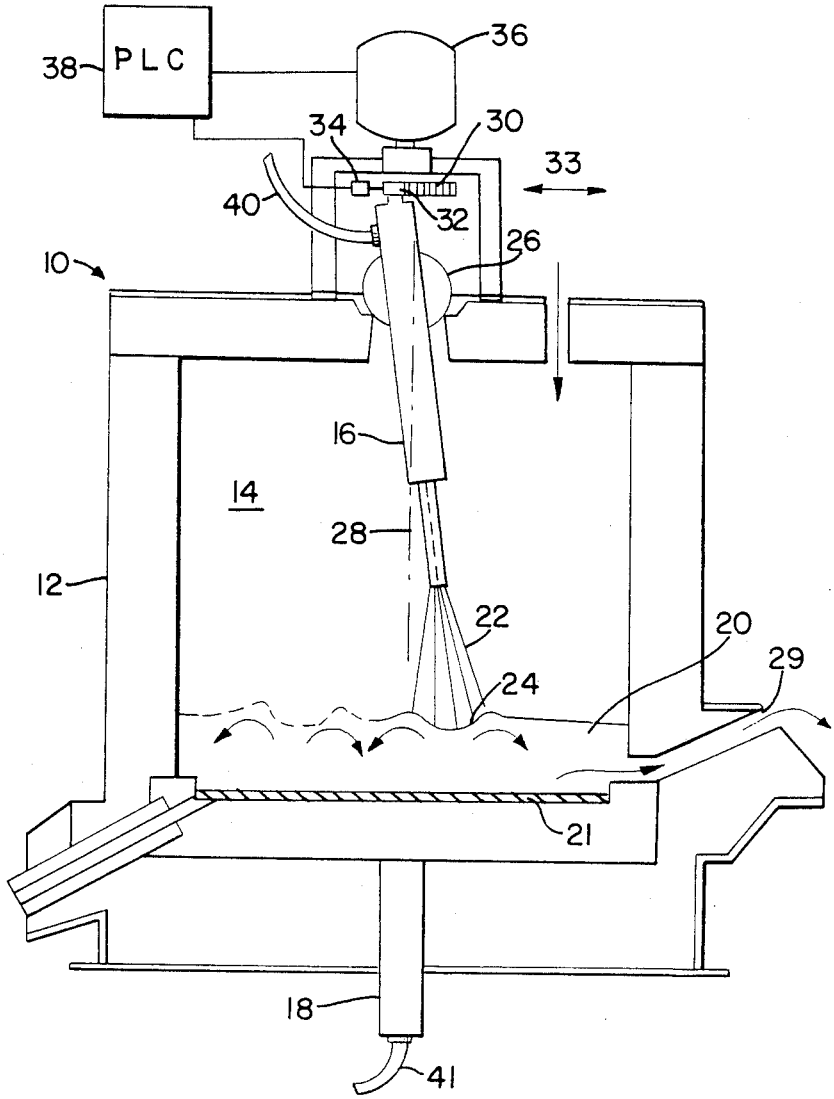
FIG. 1 shows a side view of a plasma electric arc furnace constructed in accordance with an embodiment of the present invention.

FIG. 1 illustrates a plasma arc furnace constructed in accordance with an embodiment of the present invention. The plasma arc furnace has furnace walls 12 which enclose a reaction chamber 14. Inside the reaction chamber 14 is a plasma torch 16, which interacts with a counter electrode 18. The reaction chamber 14 contains a bath 20 which is the material to be heated. The bath 20 comprises slag with metallic particles in suspension and a collector metal layer 21. The slag may continuously or intermittently flow from the furnace through spout 29.

The bath 20 is heated by a high temperature jet of ionized gas, i.e., a plasma flame 22 which flows from the tip of the plasma torch 16 towards the surface of the bath 20. The flame 22 impinges upon the slag layer and superheats the slag at the impingement zone. The temperature of the plasma gas flame may be in excess of 10,000° C. This flame maintains the temperature in the surrounding furnace atmosphere at 1,500°-2,000° C. The impingement of the flame 22 causes a superheated puddle 24 to form at the surface of the bath 20. The formation and size of the superheated puddle 24 is dependent upon the plasma gas temperature, gas flow rate, pressure, and distance from the tip of the plasma torch 16 to the surface of the bath 20.

As can be seen in FIG. 1, the impingement of the plasma flame 22 on the surface of the bath 20 causes a noticeable depression in the surface. As will be shown and discussed in more detail later, the region of slag surrounding the puddle is subject to vigorous flow circulation patterns such as indicated by the curved arrows in FIG. 1. This is due to the very low viscosity of the slag in the high temperature superheated puddle 24 and the physical displacement of slag by the impingement of the flame 22. Thus, there is both physical and convective agitation which occurs to create the circulation patterns For the following discussion, these currents will be termed "mixing currents".

The plasma torch 16 is mounted in the furnace 10 by a universal joint 26 which allows a wide range of motion for the torch 16. Thus, the plasma torch 16 can be precessed via the universal joint 26, as well as inclined relative to the vertical axis 28.

The top of the plasma torch 16 is connected to a horizontally extending track 30 via a track connector 32. This track connector 32 is movable in either direction along the track 30 in the direction of arrows 33. As the track connector 32 moves along the track 30, the angle of inclination of the plasma torch 16 relative to the vertical axis 28 will change. The movement of the track connector 32 is accomplished through a variable speed motor 34, attached to the track 30 so as to be rotatable with the track 30. The variable speed motor 34 is coupled to the track connector 32 so as to be able to move the track connector 32 along the track 30 at a variable speed.

The track 30, along with variable speed motor 34, is rotated in a circular motion by a second motor 36.

The variable speed motor 36 and the variable speed motor 34 are controlled by a programmable logic controller (PLC) 38, such as one commercially available from Texas Instruments. As will be described in more detail later, the PLC 38 controls the variable speed motor 36 and the variable speed motor 34 to cause the plasma torch 16 to follow a prescribed pattern of motion.

Electric power for the plasma torch 16 is provided by power supply cables 40 and 41.

Figure 2:
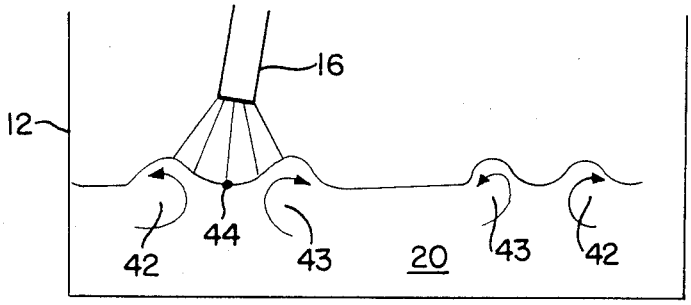
PRIOR ART FIG. 2
FIG. 2 shows a cross section of mixing currents created by a locus of impingement that is moved in a circular path as in the prior art.
Figure 3:
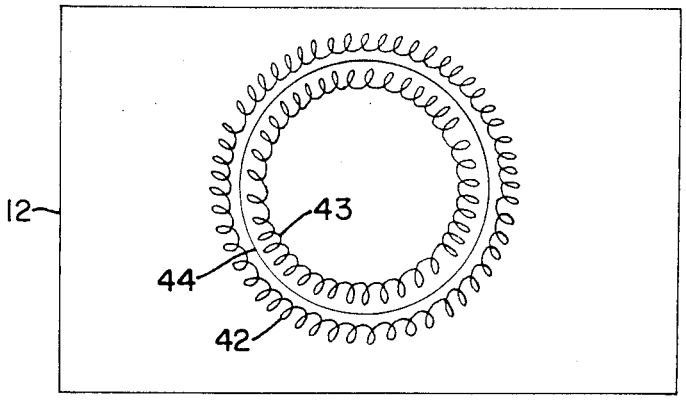
PRIOR ART FIG. 3
FIG. 3 is a top view of the circular path of a locus of impingement and the mixing currents created thereby, as known in the prior art.

FIGS. 2 and 3 illustrate how the plasma torch 16 was moved in the prior art. In FIG. 2, the impingement of the flame 22 on the surface of the bath 20 causes a depression centered at the locus 44 of the impingement. On either side of the locus 44, mixing currents 42 and 43 are formed as described earlier in FIG. 1. These mixing currents 42, 43 rotate in opposite directions, as indicated by the direction of the arrows.

In the prior art, the plasma torch 16 is moved such that the flame 22, and particularly the locus 44 of the flame 22, traveled in a circular path. The circular path is illustrated in the top view of the motion path as shown in FIG. 3. The circular path thereby creates an outer torus 42 and an inner torus 43 of mixing currents.

Figure 4:
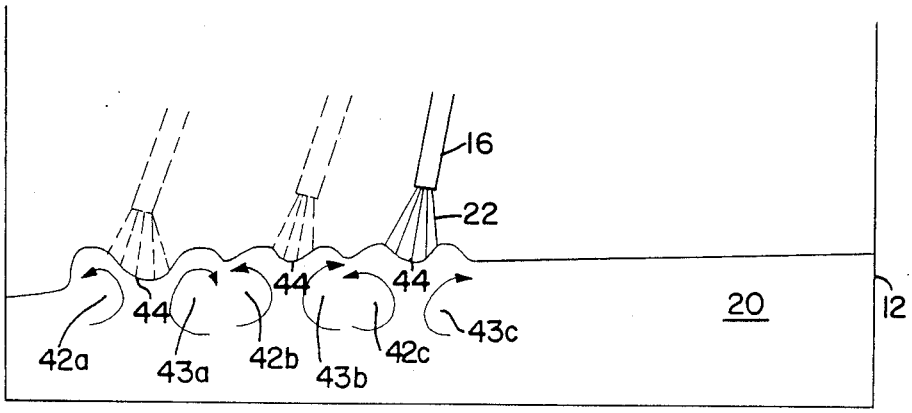
FIG. 4 illustrates the overlapping of adjacent mixing currents when the locus of impingement is moved along a motion path according to the present invention.
Figure 5:
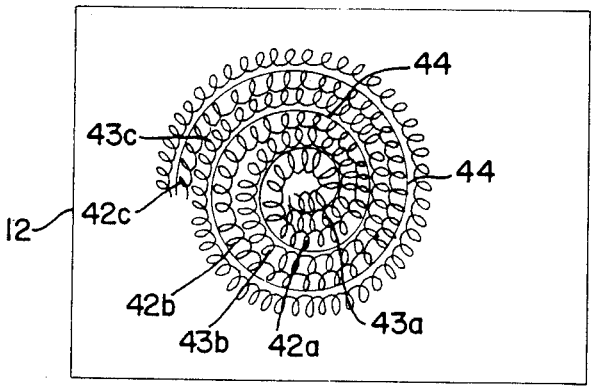
FIG. 5 describes a motion path of a locus of impingement and the mixing currents created thereby when the locus of impingement is moved according to the present invention.
Figure 6:
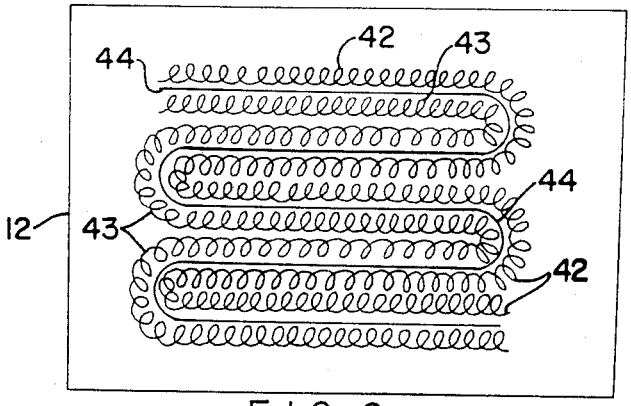
FIG. 6 shows another embodiment according to the present invention of a motion path for a locus of impingement and the mixing currents created thereby.

It has been found that moving the plasma torch 16 in a path so that the two mixing currents will interact with one another increases the stirring or agitation so that the metal collection mechanism is enhanced. This is best illustrated in FIGS. 4 to 6. In FIG. 4, the mixing currents 42*a*, 43*a* and 42*b*, 43*b* represent cross-sections of the currents 42, 43 created by the earlier tracing of the impingement locus 44 on the bath 20. The cross-section 42*c*, 43*c* of currents 42 and 43 depict the present position of the plasma torch 16 and impingement locus 44. As can be seen in the drawing, the path of the impingement locus 44 is such that mixing currents 42 and 43 interact at cross-sections 43*a*, 42*b* and 43*b*, 42*c* since the mixing currents 42 and 43 overlap in these regions. Overlapping of the regions causes greater agitation in the bath so that there is more rapid agglomeration of metallic particles and therefore a greater amount of metal collection for a given time period.

The process in which the overlapping of the mixing currents is useful is in a process for recovery of platinum group metals from catalyst matrices comprising ceramic oxide materials, where the catalyst is mixed with flux materials to produce a low viscosity slag. The slag melts at approximately 1400° C. and the operating temperature of the slag in the furnace is 1500°-1600° C. to ensure low viscosity and efficient separation. The platinum group metals are in a very finely divided state. It is commercially important to achieve very efficient separation of the platinum group metals from the catalyst matrices, and this can be done in a plasma electric arc furnace as described above. Such a process is used in the recovery of platinum group metals from catalyst used in automobile catalytic converters, as well as in recovering platinum from petroleum refining catalysts and chemical process catalysts.

In the separation of platinum group metal alloys from slag in such a furnace, experiments have shown a reduction of platinum losses to slag of approximately 29% when the locus of impingement 44 is moved in a continuously overlapping spiral path instead of a circular path. Such a path is shown in FIG. 5. The continuous overlapping provided by the spiral path can also be provided by causing the plasma torch 16 to follow other paths. An example is shown in FIG. 6 which shows a back and forth motion followed by the impingement locus 44. In such a case, the overlapping regions are caused by doubling back of a mixing current upon itself, rather than interaction between the two mixing currents. In other words, the increased agitation is due to the interaction of a subsequently created portion of a mixing current with a previously created mixing current portion. By contrast, in the earlier example, an inner mixing current and an outer mixing current are made to have partially overlapping portions, in order to increase agitation and agglomeration.

The following are two examples of tests of the apparatus of the present invention, and compares the results of tests in which the angle of inclination of the plasma torch is fixed or variable.

EXAMPLE 1

The angle of inclination from the vertical axis of the plasma torch was continuously varied from 4 degrees to 9 degrees while the rotation speed of the electrode tip was maintained constant at 30 r.p.m. The spiral traverse time was 50 seconds from 4 degrees to 9 degrees describing a spiral motion path which provides regions of overlap between inner and outer mixing currents. The furnace was charged with 50 lbs. of collector metal to form a molten layer before the feed was introduced to the furnace. The reed material to the furnace was a 50/50 mixture of alumina pellets about ⅛" diameter, containing 1% iron oxide as a precursor for additional collector metal and about 350 parts per million of platinum and 160 parts per million palladium, and crushed burnt lime sized minus 1/16" diameter. The average feedrate was 2,053 lbs/hour for two periods each 14.8 hours; one period with the angle fixed at 7 degrees and one period with the angle varying continuously from 4 degrees to 9 degrees. The slag produced in both periods was analyzed to measure the losses of platinum and palladium to slag.

| | angle of inclination | slag assay* | | % change | |
|---|---|---|---|---|---|
| | | Pt | Pd | Pt | Pd |
| Test 1 | fixed, 7° | 14 | 4 | 100 | 100 |
| Test 2 | variable, 4°-9° | 10 | 3 | 71 | 75 |

*parts per million

The operation with varying angle of inclination had 29% lower loss to slag of platinum (14-10/14) and 25% lower loss to slag of palladium. (4¾). (Test 1 was used as a baseline to demonstrate the increase in recovery using the invention.)

EXAMPLE 2

The angle of inclination from the vertical axis of the plasma torch was continuously altered from 4 degrees to 9 degrees and the rotation speed of the plasma torch was increased from 32 rpm to 42 rpm as the angle was increased. The spiral traverse time was 23 seconds from 4 degrees to 9 degrees describing a spiral motion path which provides regions of overlap between inner and outer mixing currents. The furnace was charged with 50 lbs of collector metal to form a molten layer before the feed was introduced to the furnace. The feed material to the furnace was a 51/49 mixture of alumina pellets and lime as used in Example 1 above. The average feedrate was 2,200 lbs/hr for two test periods each 6 hours; one period with the angle fixed at 7 degrees and rotation speed constant at 30 rpm and one period with the angle and rotation speed varying. The slag produced in both periods was sampled at frequent intervals and the samples were crushed finely for magnetic separation of any entrained metallic prills and for assay of the slag to measure the losses of platinum and palladium to the slag.

| | angle of inclination | rotation speed | slag magnetics content | % change magnetics | slag assay* | |
|---|---|---|---|---|---|---|
| | | | | | Pt | Pd |
| Test 3 | fixed, 7° | 30 rpm | 0.13% | 100 | 14 | 4 |
| Test 4 | variable, 4°-9° | 32-42 rpm | 0.07% | 54 | 13 | 3 |

*parts per million

The operation with varying angle and rotation speed had 46% lower content of entrained metal particles (0.13-0.07/0.13).

The increased agitation due to the overlapping spiral path of the plasma flame in Test 4 improved agglomeration and separation of the metallic particles. (Test 3 was used as a baseline to demonstrate the increase in recovery using the invention.)

As stated earlier, the movement of the plasma torch 16 is controlled by the PLC 38 through the motors 36 and 34. The velocity of the tip of the plasma torch 16 can either be held constant or varied, depending upon which path the impingement locus is to follow. For example, when following the continuously overlapping spiral path shown in FIG. 5, it is advantageous if the impingement locus travels faster as it moves further from the center in order to achieve maximum interaction of the overlapping mixing currents. In other words, if the impingement locus moves at the same speed throughout the spiral path, the mixing current towards the center of the spiral may be too quiescent by the time the overlapping mixing current is created to interact with the inner mixing current and enhance agglomeration.

The programming of the PLC to control the motors to cause the impingement locus to travel any number of paths is within the programming skill of one of ordinary skill in the art.

What is claimed:

1. A method of recovering metallic particles from non-metallic material in a plasma electric arc furnace, comprising the steps of:

creating a superheated puddle in a bath of said metallic particles and said non-metallic material by impingement of a plasma arc flame on said bath, with mixing currents being created on either side of a locus of the impingement of the flame;

moving said locus in a motion path of thereby move said superheated puddle and create said mixing currents on either side of the motion path of said locus; and controlling the motion path of said locus such that said mixing currents at least partially overlap one another.

2. The method of claim 1, wherein said controlling step includes the controlling of the motion of said locus to follow a continuous spiral path.

3. The method of claim 2, wherein said controlling step includes the controlling of the velocity of said locus along said spiral path.

4. The method of claim 1, wherein said flame is created by a plasma arc torch, and wherein said controlling step includes continuously changing an angle of inclination of said plasma arc torch as said locus is moved.

* * * * *